US005279088A

United States Patent [19]

Heydon

[11] Patent Number: 5,279,088

[45] Date of Patent: Jan. 18, 1994

[54] WALL STRUCTURE AND METHOD OF FORMING THE SAME

[75] Inventor: John J. Heydon, Big Bear Lake, Calif.

[73] Assignee: Heydon Building Systems International, Limited, London, England

[21] Appl. No.: 822,405

[22] Filed: Jan. 17, 1992

[51] Int. Cl.[5] ..... E04B 2/76

[52] U.S. Cl. ..... 52/241; 52/223.6; 52/475; 52/488

[58] Field of Search ..... 52/261, 264, 265, 241, 52/243, 223.6, 475, 483, 488, 656.9

[56] References Cited

U.S. PATENT DOCUMENTS

| | | | |
|---|---|---|---|
| 776,419 | 11/1904 | Platt . | |
| 903,734 | 11/1908 | Larson . | |
| 904,588 | 11/1908 | Wightman . | |
| 994,027 | 5/1911 | O'Beirne . | |
| 1,100,531 | 6/1914 | Cahill . | |
| 1,106,584 | 8/1914 | Robbins . | |
| 1,130,722 | 3/1915 | Fletcher . | |
| 1,226,214 | 5/1917 | Hopkins . | |
| 1,345,156 | 6/1920 | Flynn . | |
| 1,364,880 | 1/1921 | Jester . | |
| 1,785,067 | 12/1930 | Bemis . | |
| 1,810,891 | 6/1931 | Bemis . | |
| 1,924,724 | 8/1933 | Olney . | |
| 1,958,771 | 5/1934 | Simons . | |
| 1,962,514 | 6/1934 | MacWilliam . | |
| 1,995,264 | 3/1935 | Mason . | |
| 2,025,529 | 12/1935 | Scudder . | |
| 2,077,750 | 4/1937 | Fish . | |
| 2,177,699 | 10/1939 | Fisher | 52/241 |
| 2,181,698 | 11/1939 | Langenberg . | |
| 2,290,339 | 7/1942 | Leach . | |
| 2,351,615 | 6/1944 | James . | |
| 2,465,687 | 3/1949 | Jacobsen . | |
| 2,523,920 | 9/1950 | Piatt . | |
| 2,647,392 | 8/1953 | Wilson . | |
| 2,669,861 | 2/1954 | Clutter . | |
| 2,938,376 | 5/1960 | Workman et al. . | |
| 3,113,401 | 12/1963 | Rose . | |
| 3,138,898 | 6/1964 | Carter . | |
| 3,147,336 | 9/1964 | Mathews . | |
| 3,186,130 | 6/1965 | Gray . | |
| 3,228,158 | 1/1966 | Russell . | |
| 3,255,562 | 6/1966 | Altschuler . | |
| 3,331,173 | 7/1967 | Elsner . | |
| 3,353,315 | 11/1967 | Barker . | |
| 3,410,044 | 11/1968 | Moog . | |
| 3,449,878 | 6/1969 | Hern . | |
| 3,552,076 | 1/1971 | Gregori . | |
| 3,667,180 | 6/1972 | Tischuk . | |
| 3,712,004 | 1/1973 | Loebsack . | |
| 3,784,312 | 1/1974 | Gordon . | |
| 3,788,020 | 1/1974 | Gregori . | |
| 3,791,082 | 2/1974 | Bowling . | |
| 3,807,112 | 4/1974 | Perina | 52/241 |
| 3,841,043 | 10/1974 | Zinn | 52/243 |
| 3,964,228 | 6/1976 | Nilsen . | |
| 3,992,844 | 11/1976 | Gretter . | |

(List continued on next page.)

OTHER PUBLICATIONS

Foam-Core Panels Survey from "Fine Homebuilding" Magazine, Sep. 1990, No. 62.

Ener-G-Corporation Brochure; 1990.

Covington Technologies "Building System" Brochure; 1989.

R Control "Structural Building Panel" Brochure; 1990.

*Primary Examiner*—Michael Safavi

*Attorney, Agent, or Firm*—Stetina and Brunda

[57] ABSTRACT

A wall structure comprising a track, a plurality of vertical posts secured to the track at predetermined locations, a plurality of horizontal header beams bridging the posts and secured to the posts, and a plurality of wall sections having a grooved side and tongue side and adapted to receive the track in its bottom side, the header beams in its top side, the wall sections assembled together in a tongue and groove relationship along the wall structure with the posts being encapsulated in the tongue and groove joint to form a monolithic wall structure.

15 Claims, 5 Drawing Sheets

U.S. PATENT DOCUMENTS 4,019,298 4/1977 Johnson et al. .
4,147,004 4/1979 Day et al. .
4,180,956 1/1980 Gross .
4,223,501 9/1980 DeLozier .
4,242,390 12/1980 Nemeth .
4,263,765 4/1981 Maloney .
4,416,097 11/1983 Weir .
4,439,967 4/1984 Dielenberg .
4,614,013 9/1986 Stevenson .
4,614,071 9/1986 Sams et al. .
4,706,429 11/1987 Young .
4,833,855 5/1989 Winter, IV .
4,894,969 1/1990 Horobin .

WALL STRUCTURE AND METHOD OF FORMING THE SAME

FIELD OF THE INVENTION

This invention is directed to a wall structure for residential and commercial buildings and a method of forming the same. More particularly, this invention is directed to an integrated wall structure formed of pre-apertured track, post and beam structural framing elements, and interlocking foam wall panels which result in a monolithic building structure.

BACKGROUND OF THE INVENTION

A number of attempts have been made to develop a wall structure that integrates framing and wall panels to form a complete wall. For example, see U.S. Pat. Nos. 3,552,076; 3,788,020; 3,992,844; 4,706,429; 4,147,004; 4,833,855; and 4,894,969. Some of these structures comprise an assembly of wall panels or wall bricks having hollow passages which form a series of interlocking vertical and horizontal passages in the assembly. The passages are filled with concrete, with or without rebar, to form structural framing integral with wall panel or bricks. Other structures comprise reinforced composite wall panels that are interlocked to form a wall structure. A third type of structure comprises an assembly of foam plastic forms that function as permanent concrete forms after the concrete has been poured between the forms.

Although these various prior art structures apparently are easy to assemble, they require substantial planning and piecemeal methods for forming windows and doors. This is especially true when poured concrete is an essential element of the structure. These prior art structures can require a substantial amount of concrete. Concrete in some form is widely available, but the concrete goods vary and in many areas of the world, the concrete is not of structural load bearing quality. Thus, in many areas of the world structural concrete is difficult and/or expensive to obtain.

The present invention specifically addresses these and other deficiencies in the prior art and provides an integrated frame/wall panel wall structure that employs no concrete, is fabricated from a minimum number of standard framing elements, and a standard wall panel. The structure can be assembled with a minimum of tools and does not require employment of skilled professionals, such as carpenters, brick layers, and concrete pourers.

The present wall structure comprises various prefabricated framing elements, namely a post or stud, a U-shaped track, a header beam, and various brackets and fasteners, namely a corner bracket, a foundation bolt, a shoulder bolt, and a self-tapping screw. Standard window sills and door headers are pre-cut. Window jambs, door jambs, etc. are connected to the posts or studs with the standard corner bracket and self-tapping screws. The posts are connected to the U-shaped track with the self-tapping screws. The top of the posts are connected to the header beams with a standard bracket and shoulder bolt. The header beams are joined together end-to-end with a bracket on the top and bottom of the beams or with a bracket on the bottom and a standard strap on the top.

A minimum number of tools are required to assemble the wall structure: a hot knife or saw to cut the wall panel, a screw driver and/or socket wrench to tighten the self-tapping screws, a wrench or socket wrench to tighten the shoulder bolt and the foundation bolt or nut, and a drill and bits to drill any additional apertures for the self-tapping screws, the shoulder bolts and/or the foundation bolt.

SUMMARY OF THE INVENTION

The improved wall structure of the present invention comprises a U-shaped, pre-apertured elongated track secured to a horizontal foundation means or structure floor, the track has a bottom wall resting on the foundation, and opposing side walls extending upwardly from the bottom wall; at least two elongated vertical posts of predetermined lengths, each post having an opened bottom end secured at predetermined locations along the length of said track; and elongated horizontal header beams secured to the top ends of adjoining posts to form a rectangular frame. The track is affixed to the foundation means by fasteners, such as bolts extending through apertures formed in the bottom wall of the track at the predetermined locations along the track. Preferably each bolt extends through and compresses an anchor washer against the bottom wall of the track to secure the track to the foundation means. Each anchor washer's external shape is preferably adapted to be received within the open bottom end of the post and a male/female union. In this arrangement, the posts can be easily placed in register with respect to the track during the fabrication of the wall. The side walls of the track during fabrication prevent traverse movement of the bottom of the post. The anchor washer prevents longitudinal movement of the post within the track. Preferably the side walls of the track and the bottom portion of the post have pre-punched apertures in register to receive self-tapping screws to secure the post to the track. The lower header beam brackets are secured to the top end of the posts and to ends of the adjoining header beams to join the header beams to one another in an end-to-end relationship and to secure the joined header beams to the posts. The bottom side of the header beams are attached to the lower header beam brackets, and the top side of the header beams are secured to the ends of adjoining header beams with an upper header beam bracket or with a header beam strap. If the header beam union is desired to support a floor joist or ceiling joist, the upper header beam bracket is advantageously used since the fingers of the header beam bracket can be secured to such joists. If no joist or other structural members are desired to be attached to the header beam of the union, the header beam strap may be used.

Each header beam bracket preferably includes a body portion of a predetermined thickness, fingers extending normal from two opposing sides of the body portion adapted to be secured on the top portion of a post (or joist), and opposing ears extending outwardly from the opposing sides of the body portion with each ear being adapted to be secured to the end of a header beam. Preferably the fingers and the top portion of the post have pre-formed apertures in register to receive self-tapping screws to secure the fingers of the bracket to the top portion of the post. Preferably the ears of each bracket, the header beams at both ends, and the header beam strap include bolt apertures which are in register when the bracket, header beam, and strap are assembled to receive a shoulder bolt means to secure the lower header beam bracket to the bottom wall of the two header beams and the header beam strap (or upper header beam bracket) to the top walls of the header beams. The shoulder bolt means is used to prevent the collapse of the header beam when bolting the lower header beam bracket to the bottom wall of the header beams and the header beam strap (or upper header beam bracket) to the top wall of the header beams. The length of the unthreaded shank on the shoulder bolt is such that when the shoulder bolt is inserted through the bolt aperture in the header beam strap (or upper header beam bracket), the bolt's head rests on top of the strap (or upper header beam bracket) and the shoulder of the unthreaded shank rests on the interior surface of the header beam's bottom wall. The bolt aperture in the bottom wall of the header beam is preferably sized of smaller diameter than the diameter of the unthreaded shank portion of the shoulder bolt but larger than the threaded portion of the shoulder bolt, thereby allowing the threaded portion to extend through the bottom wall bolt aperture. Thus, when the bolt is tightened down, the shoulder on the shoulder bolt bears the compressive force with the bolt nut, bottom wall of the header beam, and the bracket rather than the bolt's head, the bolt nut, the top and bottom wall of the header beam, and the bracket, thereby preventing the collapse of the header beam.

Preferably the header beam on its top and bottom sides at each end has slots and the ends of the ears of the header beam bracket and the opposing ends of the header beam straps terminate with perpendicular tabs adapted to be received in the slots of the header beams when the lower header beam bracket, header beam strap (or upper header beam bracket), and header beams are assembled.

In the preferred embodiment of the present invention, at least one prefabricated foam wall section is positioned between two adjacent posts and seated in and around the track on its bottom edge and seated in and around the header beams on its top edge. Preferably each wall section includes two parallel grooves formed on its bottom side adapted to receive the side walls of the track, a channel formed on its top side adapted to receive the header beams, a vertical groove formed on one of its vertical sides adapted to receive a post and a vertical tongue of an adjoining wall section, and a vertical tongue formed on its second vertical side adapted to be received in the vertical groove of a second adjoining wall section. As such with adjoining wall panels assembled together, the wall panels encapsulate the track, post, and beam framing elements and are interlocked together to form a monolithic structure wherein a synergistic effect is achieved by utilizing the compressive tensile and shear force properties of each of the framing elements and foam wall panels.

The front and back sides of each post may preferably include a keyhole in its bottom portion and its top portion adapted to receive cable and turnbuckle means for providing additional lateral stiffening and shear resistance of the frame when desired, and to align the sections for plumb. Each free end of the cable has a swage ball and restraining washer adapted to be inserted into the keyhole and to secure the end of the cable therein. The cable and turnbuckle means are diagonally extended from the keyhole of the top portion of one post to the keyhole of the bottom portion of another post of the wall structure. Preferably the posts are not adjoining but are spaced apart with at least one additional post. In a preferred embodiment, the cable and turnbuckle means extends from the bottom portion of a first post to the top portion of the second post and from the bottom portion of the second post to the top portion of a first post to form a cross corner to corner stiffening arrangement which prevents lateral movement of the frame in either direction. The turnbuckles are tightened down to tighten the turnbuckle cable system. Preferably, channels are cut in the wall section from the keyhole of one post diagonally to the keyhole of another post so that the cable and turnbuckle system can reside in the channel. The channel can be filled after the turnbuckle and cable assembly is installed with plastic foam to seal the cable and turnbuckle system. The channel can be preformed in the wall panel or conveniently formed in the wall panel on the job site by using an electrically heated hot knife.

Due to the dimensional stability of the pre-apertured framing elements and the interlocking foam wall panels, the wall structure of the present invention can be rapidly assembled by unskilled labor utilizing solely a screw driver and/or wrench and provide a resultant wall structure having superior strength, durability, and thermal efficiencies.

BRIEF DESCRIPTION OF THE DRAWINGS

These as well as other benefits of the present invention will become self evident upon reference to the drawings wherein.

DETAILED DESCRIPTION OF THE PREFERRED EMBODIMENT

Figure 1:
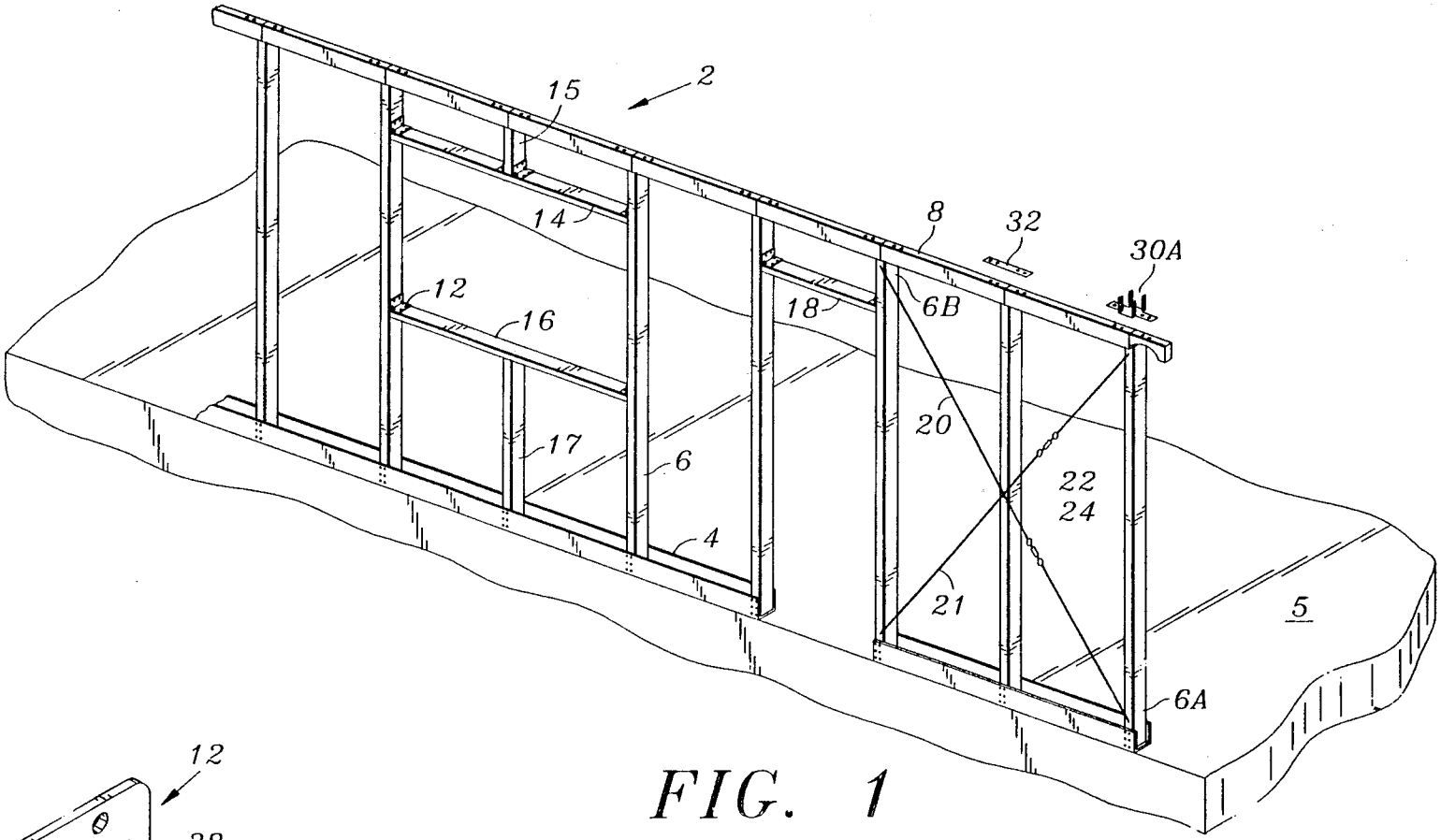
FIG. 1 is a perspective view of the framing elements of the wall structure of the present invention assembled upon a foundation with the interlocking foam wall panels removed therefrom.
Figure 3:
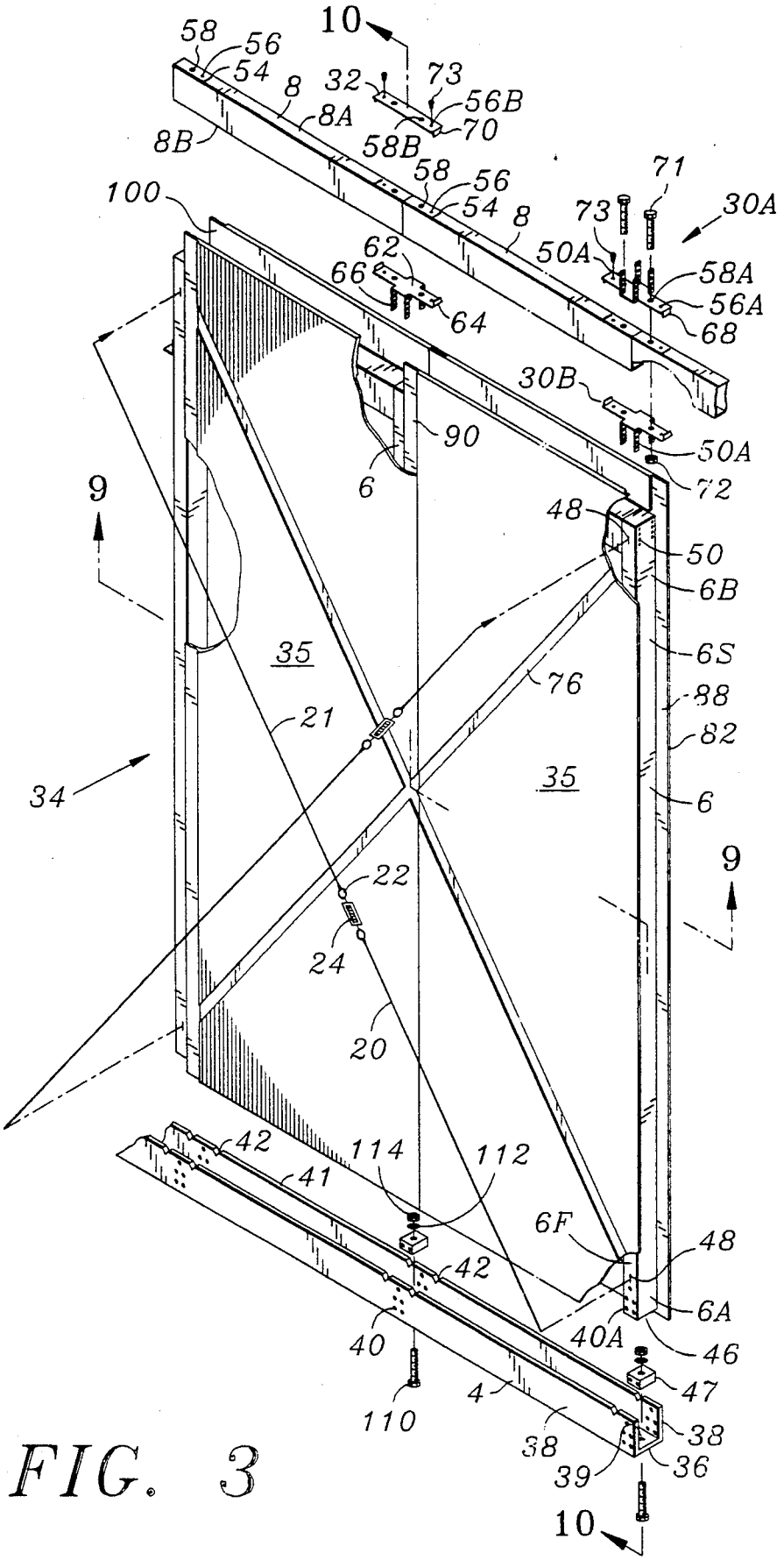
FIG. 3 is a perspective view of the framing and wall section of the wall structure.

Referring to FIG. 1, the frame 2 of the improved building system of the present invention is formed of a variety of prefabricated dimensional stabile frame elements comprising a track 4 anchored to a foundation 5, vertical studs or posts 6 attached to the track, horizontal header beams 8 fixed to the top of the posts with header beam brackets 30 (shown in FIGS. 3 and 4), head jamb 14 secured to the posts with corner brackets 12, window sill 16 secured to the posts with corner brackets 12, vertical framing post 15 secured to the header jamb and header beam with corner brackets, vertical framing post 17 secured to the window sill 16 with corner brackets (not shown) and track 4, and door header 18 secured to the posts with corner brackets. The frame may additionally be laterally braced with a cable system 20 which is diagonally attached as shown in FIG. 3 between the bottom portion 6A of one post and the top portion 6B of another spaced apart post. The cable system comprises cables 21, screw eyes 22, and turnbuckles 24.

Foundation 5, although depicted as a concrete slab in FIG. 1, is not so limited. The present invention can also be utilized with other type conventional foundations such as raised concrete foundations, wooden joists, or the like.

The header beams are connected end-to-end on top of the posts with header beam brackets and header beam straps as more fully explained below.

Figure 2:
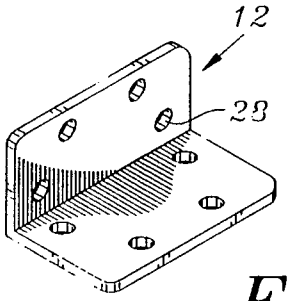
FIG. 2 is a perspective view of a corner bracket of the framing.

The header jambs 14, window sills 16, door headers 18, framing posts 15 and 17, window side jambs and door jambs (not shown) are preferably formed of dimensionally stabile material such as tubular steel stock and/or laminated veneer wood products and are attached to the posts with corner brackets. The brackets can be attached to one side of each framing element as shown with respect to the window sill 16 and door header 18 or to two sides as shown for framing post 15. These framing elements are prefabricated, and pre-cut to length and preferably include apertures formed along their length for receiving threaded fasteners. The corner bracket 12 shown in FIG. 2 has pre-punched apertures 28 to receive self-tapping screws (not shown) for securing the bracket to the framing elements. However, the corner bracket can also be welded or riveted to the framing elements.

In FIG. 3 the entire improved wall structure assembly 34 is illustrated. The assembly comprises the framing elements and cable system described above and wall sections 35.

Figure 3A:
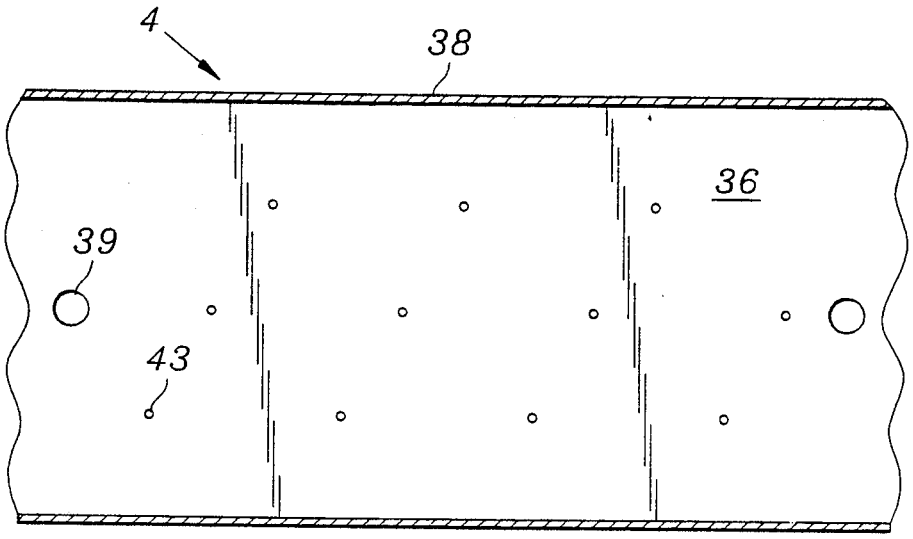
FIG. 3A is a top elevational view of the track framing element.

The track 4 preferably comprises a U-shaped channel having a bottom wall 36 and vertical side walls 38. The side walls have pre-formed apertures 40 located at predetermined positions along the length of the track for receiving self-tapping screws (not shown) to secure the posts 6 to the track. The bottom wall 36 has plural bolt apertures 39 for securing the track to the foundation as shown in FIG. 3A. The pre-punched apertures 43 provide additional or alternative means for securing the track to the foundation.

The top edge 41 of each side wall includes a series of V-shaped notches 42 located at predetermined positions along the length of the track. The notches are registration indices for positioning a drill motor and drill bit for drilling the foundation anchor means apertures and the post as described below.

Each post 6 has an open bottom end 46 adapted to receive an anchor washer 47 to register position of the post in the track. The bottom portion 6A of the post in its front and rear walls 6F and 6B has pre-punched starter holes or apertures 40A in register with apertures 40 of the track to receive the threaded shanks of self-tapping screws (not shown) to secure the post to the track. In certain high-shear load applications, the bottom and top portions 6A and 6B of the post may additionally include keyholes 48 for anchoring the cable system 20. The top portion in the side walls 6S of the post has pre-formed starter apertures for receiving the threaded shanks of self-tapping screws (not shown) to secure the lower header beam bracket 30B to the top of the post. The front and rear surfaces and top and bottom portions are identical and either surface can be the front or rear surface and either end can be the top or bottom. This minimizes confusion during construction.

The header beams 8 span the horizontal distance from the centers of adjoining posts 6. The header beams 8 are preferably formed of tubular metal such as steel and have slots 54 formed at both ends on the top and bottom surfaces 8A and 8B for receiving the end tabs 68 and 70 of the lower bracket 30B and strap 32 (see FIG. 4). The header beam 8 also has pre-punched starter apertures 56 for self-tapping screws and bolt apertures 58 at both ends on the top and bottom surfaces. The bolt aperture 58 on the top surface of header beam 8 has a larger diameter than the bolt aperture on the bottom surface so that a shoulder bolt 71 may be used in securing the header beam 8 to the lower header beam bracket 30B. The larger bolt aperture in the top surface allows the unthreaded shank of the shoulder bolt to pass therethrough.

Each header beam bracket 30A and 30B includes a body portion 62 with longitudinally extending ears 64 and perpendicularly extending fingers 66. Each ear 64 has a bolt aperture 58A and pre-punched aperture 56A and an end tab 68. Each ear of bracket 30B preferably contains a depression or indentation 60 to receive a spline nut 72. The depression aids in bolting the header beam to the lower header beam bracket 30B as will be discussed below. When the lower header beam bracket is attached to a header beam and the tab 68 is positioned in slot 54, the apertures 56A and 58A are in register with the apertures 56 and 58 of the header beam 8.

The fingers are adapted to receive the top portion 6B of a post 6. Each finger has pre-punched apertures 50A adapted to receive self-tapping screws (not shown) which are in register with starter apertures 50 in the side walls 6S of the posts.

The upper header beam bracket 30A can be attached to the top surfaces of the header beam to receive ceiling joists (not shown) or reel rafters (not shown) between fingers.

The header beam strap 32 has perpendicularly extending tabs 70 at each end adapted to be received in slots 54 of end-to-end aligned header beams. Each strap has prepunched apertures 56B for receiving self-tapping screws 73 and bolt apertures 58B. When the strap is attached to header beams 8 and the tabs 70 are positioned in slots 54, the apertures 56B and 58B are in register with the apertures 56 and 58 of the header beam. The use of self-tapping screws 73 is optional. The screws are helpful in assembly at the wall system, but the end tabs and shoulder bolts are sufficient to align the header beams in a straight line.

The frame 2 of the assembly 34 is encapsulated within plural prefabricated interlocking wall sections 35 as described below. The wall sections can be manufactured from a number of materials, but in the preferred embodiment, a foam polymer, such as styrofoam, is utilized because of its relatively low cost, light weight, insulating properties, stability, ease of cutting, ease of repairing, and the like. The sections are preferably incorporated into the assembly 34 during assembly of frame 2.

Figure 9:
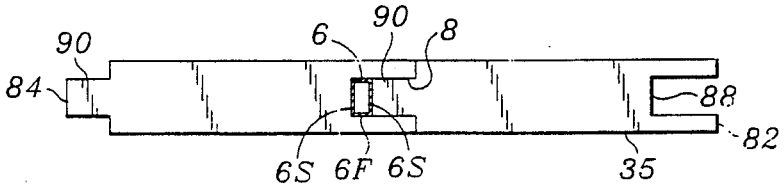
FIG. 9 is a cross-sectional view of the wall structure taken along line 9—9 of FIG. 3.

Referring to FIGS. 3 and 5 through 10, wall section 35 is formed having a bottom end 78, a top end 80, a grooved side 82, and a tongue side 84 adapted to receive a tongue 90 of a second section 35 in a tongue and groove relationship with a post 6 incorporated in the tongue and groove (see FIG. 9). The bottom end 78 has a tongue 94 separated from outer skirts 96 by grooves 98. The grooves 98 are adapted to receive side walls 38 of the track 4 (see FIG. 10) and the channel of the track is adapted to receive the tongue 94. The top end 80 has a channel 100 adapted to receive a header beam 8 (see FIG. 10).

Adjacent wall sections are affixed together with a polymeric foam adhesive applied between the sides of the tongue 90 and the side walls of the receiving channel 88. Any voids between the framing and wall sections are preferably filled with such polymeric foam, thereby creating a monolithic structure of the wall section and framing with the wall sections completely surrounding, i.e. encapsulating, the framing. As such, the wall section and framing elements form a monolithic structure wherein a synergistic effect is achieved by combining the beneficial compressive, tensile, and shear force properties of each of the framing elements and foam wall panels.

In certain applications where increased shear force resistance is mandated, the wall sections can be preformed with grooves 76 (see FIG. 3) for receiving the cable system 20. Alternatively, if the wall sections are formed from foamed plastic, the grooves can be cut in the sections during construction of the assembly 34 using a conventional hot knife.

Figure 11:
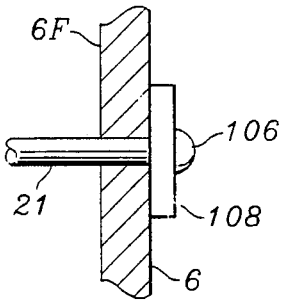
FIG. 11 is an enlarged fragmented elevational view of the cable swage ball connection with the post framing element as shown in FIG. 3.

As shown in FIGS. 3 and 11, one end of each cable 21 of the cable system 20 is secured to a screw eye 22 of a turnbuckle 24. The other end of each cable terminates a swage ball 106 securely affixed to the end of the cable. A restraining washer 108 is positioned on the cable next to the swage ball 106 distributing force across the front post wall about the keyhole 48. The cable system, after the ends of the cable with the collar and washer are threaded through the keyholes of spaced-apart posts, preferably separate, by one intervening post, in a diagonal relationship and is tightened by turning the turnbuckle. The tightened cable system nests in the groove 76. The groove can be optionally filled to present a smooth planar surface and protect the cable system from the environment and thus minimize corrosion. Filling the groove further restores insulating value, prevents the turnbuckle from loosening, and protects the cables and turnbuckle assembly from air and moisture.

With the structure defined, the method of assembling the wall structure of the present invention may be described. Initially the track is secured to a foundation 5. As previously stated, the foundation can be a concrete slab, a raised concrete foundation, a wood joist floor, and the like. For concrete foundations, the track is positioned on the foundation where a wall is to be erected. Apertures are drilled into the foundation (not shown) through bolt apertures 39 formed in the bottom wall 36 of the track 4. Foundation lug bolts 110 are then inserted into the drilled apertures in the foundation through apertures 39 in the bottom of the track and secured in the drilled apertures in the foundation with epoxy cement, expansive collars, or the like. Anchor washer 47 and bolt washer 112 are slipped over the lug bolt and the entire foundation tie-down assembly is tightened down with plural nuts 114.

Alternatively, the track can be secured to the foundation by using lug bolts, nails, or the like, in the prepunched apertures 43 (See FIG. 3A).

Figure 4:
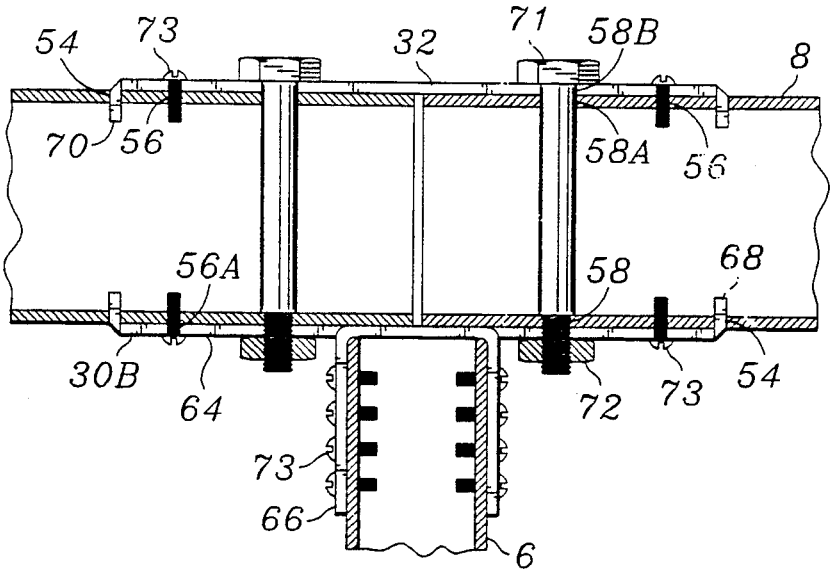
FIG. 4 is a fragmentary cross-sectional view of the juncture of the framing post and header beam elements shown in FIGS. 1 and 3.
Figure 8:
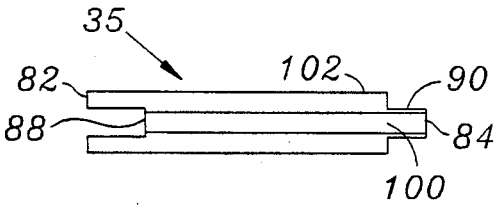
FIG. 8 is a top end view of the wall section of FIG. 5.
Figure 5:
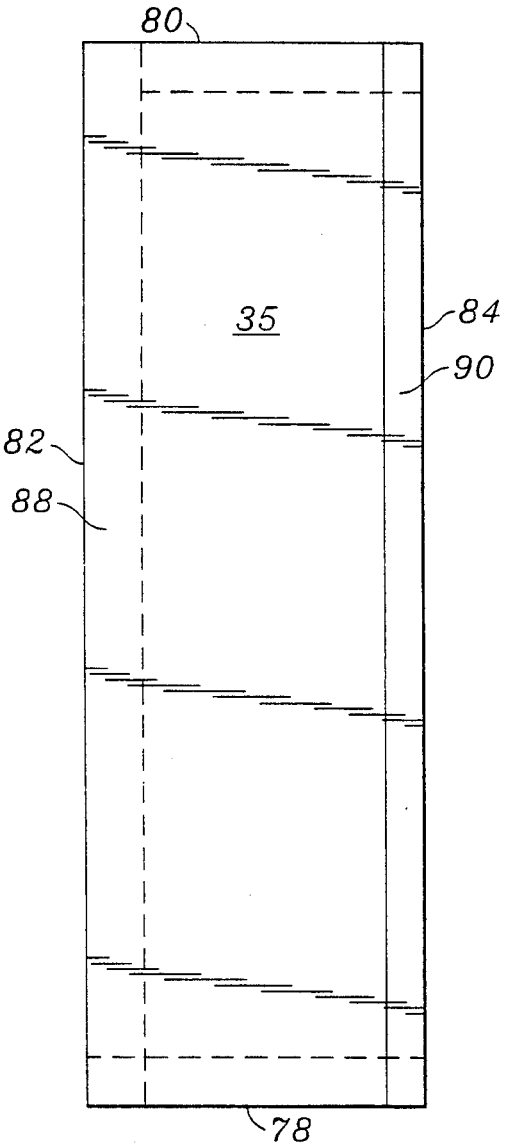
FIG. 5 is an elevational view of the interlocking foam wall section of the wall structure of the present invention.
Figure 6:
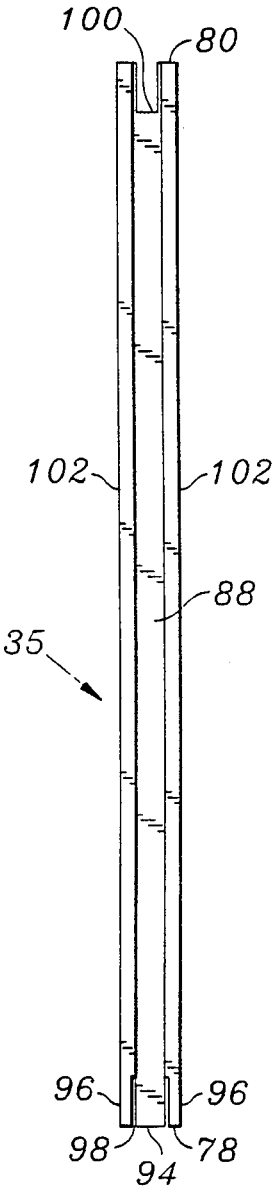
FIG. 6 is a side view of the wall section of FIG. 5.
Figure 7:
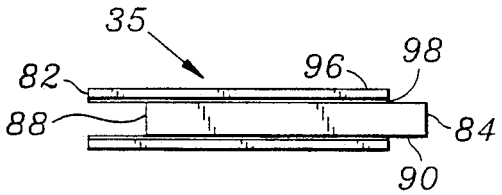
FIG. 7 is a bottom end view of the wall section of FIG. 5.
Figure 10:
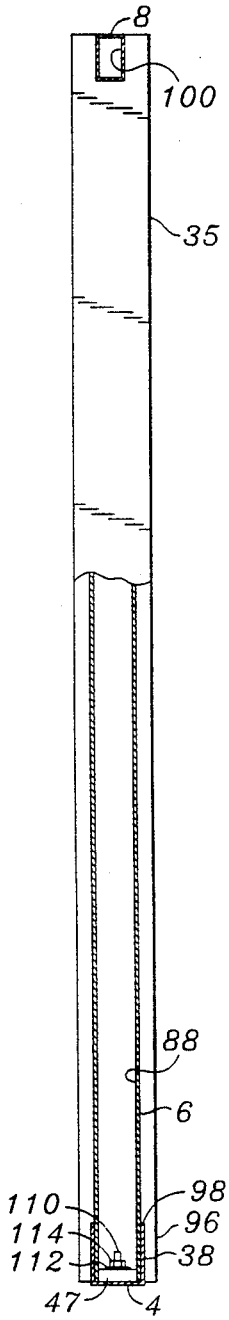
FIG. 10 is a cross-section view of the wall structure taken along lines 10—10 of FIG. 3.

After the track has been secured to the foundation, a post 6 is positioned at the end of the track over an anchor washer, a track run commences, and terminates with the foundation tie-down assembly. The open end 46 of the post receives the anchor washer to position the post and strengthen the end of the post against longitudinal and lateral forces. The anchor washer also protects the track's bottom wall when the post exerts shear forces on it. This can occur when the post is subjected to lateral forces such as wind or seismic activity. The anchor protects the bottom wall by distributing the force over a larger area of the bottom wall. The lower portion 6A of the post is fastened to the track by one or more self-tapping screws (not shown) passing through apertures 40 of the track into starter apertures 40A of the post. The screws are preferably threaded into the front and rear of the post 6. Referring to FIG. 4, a lower header beam bracket 30B is then secured to the top of the post and the fingers 66 are attached to the side walls 6S of the top portion 6A of the post with one or more self-tapping screws 73 passing through apertures 50A of the fingers (see FIG. 3) into starter apertures 50 of the post. A header beam 8 is secured to the lower bracket with a self-tapping screw 73 passing through aperture 56A of the bracket ear 64 into the starter aperture 56 of the header beam, and a shoulder bolt 71 passing through bolt apertures 58 of the header beam and threaded into spline nut 72 of the bracket and tightened down. Spline nut 72 is secured in the bracket with its splined portion extending toward the header beam. Depression or indentation 60 in ear 64 is of sufficient depth such that the spline nut's splined portion does not extend beyond the surface plane of the bracket surface in contact with the header beam.

Subsequently a first wall section 35 is positioned over the track so that the bottom grooves 98 receive the side walls 38 of the track and the groove side 82 is facing the erected post. The section is slid laterally down the track towards the post until the post is fully received in the channel 88, and the header beam is dropped down in the top channel 100 of the section. The next post with a header beam bracket attached is then erected in place in the track next to the tongue side 84 of the section in the same manner as the first post. The previously installed header beam and the next header beam are then joined end to end on the bracket by engaging the slots 54 on the bottom surface of the header beams with the end tabs 68 of the lower bracket and the slots on the top surface of the beams with the end tabs 70 of a header beam strap 32. If the header beam is going to support joists or rafters, an upper header beam bracket 30A can be used in place of the header beam strap on the top surfaces of the header beams to effect a union of the beams. The strap and bracket, or brackets, are secured to the header beam using shoulder bolt 71 and spline nut 72. A shoulder bolt is used to prevent the header beam from collapsing when the bolt is tightened. The unthreaded shank of a major diameter has a length equivalent to the interior height of the header beam plus the thickness of the top wall of the header beam plus the thickness of the strap 32. If upper header beam bracket 30A is used to secure the tops of the header beams, then the unthreaded shank of the shoulder bolt must have a length equivalent to the interior height of the header beam plus the thickness of the top wall of the header beam plus the thickness of upper bracket 30A. Preferably, the upper header beam bracket 30A and the header beam strap 32 have the same thickness so a single-sized shoulder bolt 71 can be used. The shank ends in a shoulder from which the threaded portion of a minor diameter axially extends. A standard bolt can also be used with a tube sleeve having the same diameter and length of the unthreaded shank of the shoulder bolt; the end of the tube forms the shoulder.

The assembly is built lengthwise along the track installing a post along a wall section, as described above, with the header beam, brackets, and straps. For doors and windows, the wall sections are cut to size. Channels will be cut in the wall section to assemble over window sills, door headers, etc. Further, a suitable expansive foam adhesive is successively applied to the tongue and groove interconnections of each adjacent wall panel which securely bonds the wall panels to each other as well as to the framing elements encapsulated therewithin.

After a wall assembly is assembled, the assembly, if desired, can be strengthened with a cable system 20. For plastic foam wall sections, the groove 76 is cut into the interior side of the section diagonally from the keyhole in the top portion of one post to the keyhole in the bottom portion of another post. Preferably the cable system will be installed as cross cables, shown in FIGS. 1 and 3, to give maximum strength.

Channels (not shown) in the interior side of the assembly can be cut into the sections using a hot knife for electrical wiring, plumbing, telephone lines, and other utilities, and backfilled with foam. After the cable system and utilities are installed, the interior side of the assembly can be covered with wallboard for protection from fire and the environment, and for attaching decorative finishes.

The sections form a substantially perfect plane for affixing an exterior architectural finish, such as stucco or wooden siding, or bricks, or the like. These exterior finishes protect the wall assembly from the environment, and further strengthen the assembly against lateral forces applied against it.

It is contemplated that all parts of the wall structure taught by the present invention will be pre-made in standard sizes as follows: the posts will be 1½ inches by 3 inches in cross section; the tracks will be 3 inches wide, with bolt apertures 7 inches apart and prepunched apertures ½ inch apart (see FIG. 3A); the header beams will be 5 inches by 3 inches in cross-section; and the wall sections will be 6 inches thick. The metal parts can be made of steel 1/16 to ⅛ inch thick; however other sizes and metal gauges may be used.

Thus, as described in the preferred embodiment, the improved wall structure uses prefabricated framing elements and wall sections that are easily assembled with a minimum of tools and without the use of skilled professionals. Once the frame is assembled and fastened to the foundation, the wall sections glued together, and any voids filled with foam, a strong monolithic wall structure providing energy saving insulation is created.

What is claimed is:

1. An improved wall structure comprising:

a generally U-shaped elongate track adapted to be secured to horizontal foundation means, the track having a bottom wall adapted to rest on the foundation means and opposing side walls extending upwardly from the bottom wall;

at least two elongated vertical posts of predetermined lengths having an open bottom end secured at predetermined locations along the length of said track;

an elongated horizontal header beam secured to the top ends of adjacent posts;

header beam brackets secured to the top ends of said posts and to the ends of adjoining header beams to join the header beams to one another in an end-to-end relationship and to secure the joined header beams to the posts;

header beam straps secured to the top surface of the ends of said adjoining header beams to secured said adjoining header beams to one another in an end-to-end relationship; and a prefabricated wall section disposed between said at least two elongated vertical posts and including edge portions which extend outwardly beyond said vertical posts to encapsulate said vertical posts within said wall section.

2. The wall structure according to claim 1 wherein the track is secured to the foundation means by attachment means extending through pre-formed holes in the bottom wall of said track at said predetermined locations along the track.

3. The wall structure according to claim 1 wherein an anchor washer is secured against the bottom wall of said track by tying means extending through pre-formed bolt holes in the bottom wall of said track to the foundation means.

4. The wall structure according to claim 3 wherein each anchor washer's external shape is adapted to receive the open bottom end of the post in a male/female union.

5. The wall structure according to claim 1 wherein the side walls of said track and the bottom portion of said posts have pre-formed holes in register to receive self-tapping screws to secure said posts to said track.

6. The wall structure of claim 1 wherein said wall section disposed between two adjacent posts is seated in and around said track on its bottom side and in and around said header beam on its top side.

7. The wall structure of claim 6 wherein each wall section has two parallel grooves formed on its bottom side adapted to receive the side walls of said track, a channel on its top side adapted to receive said header beams, a first vertical side with a vertical groove adapted to receive a post and a vertical tongue of an adjoining wall section and a second vertical side with a vertical tongue adapted to be received in the vertical groove of an adjoining wall section.

8. An improved wall structure comprising:

a generally U-shaped elongate track adapted to be secured to horizontal foundation means, the track having a bottom wall adapted to rest on the foundation means and opposing side walls extending upwardly from the bottom wall;

at least two elongated vertical posts of predetermined lengths having an open bottom end secured at predetermined locations along the length of said track;

an elongated horizontal header beam secured to the top ends of adjacent posts;

header beam brackets secured to the top ends of said posts and to the ends of adjoining header beams to join the header beams to one another in an end-to-end relationship and to secure the joined header beams to the posts, each of said header beam brackets having a body portion of predetermined thickness, fingers extending normal from two opposing sides of the body portion which are adapted to receive the top end of a respective one of said posts, and opposing ears extending outwardly from the opposing sides of said body portion, each ear adapted to be secured to the end of a respective one of said header beams; and a prefabricated wall section disposed between said at least two elongated vertical posts and including edge portions which extend outwardly beyond said vertical posts to encapsulate said vertical posts within said wall section.

9. The wall structure of claim 8 wherein the fingers and top portion of said post have pre-formed holes in register to receive self-tapping screws to secure the bracket to said post.

10. The wall structure according to claim 8 including header beam straps secured to the ends of said adjoining header beams on the top surface thereof to secure said adjoining header beams to one another in an end-to-end relationship.

11. The wall structure of claim 10 wherein the bracket ears, header beams, and the header beam strap have bolt holes which are in register when said bracket, header beam, and strap are assembled to receive a shoulder bolt means to secure the header beam bracket and header beam strap to adjoining header beams.

12. The wall structure of claim 10 wherein the header beam on its top and bottom sides has slots and the ends of the ears of the header beam bracket and the opposing ends of the header beam straps terminate with perpendicular tabs adapted to be received in the slots of the header beams when the header beam bracket, header beam strap, and header beams are assembled.

13. An improved wall structure comprising:

a generally U-shaped elongate track adapted to be secured to horizontal foundation means, the track having a bottom wall adapted to rest on the foundation means and opposing side walls extending upwardly from the bottom wall;

at least two elongated vertical posts of predetermined lengths having an open bottom end secured at predetermined locations along the length of said track, each of said posts having a keyhole in its bottom portion and a keyhole in its top portion to receive cable and turnbuckle means;

an elongated horizontal header beam secured to the top ends of adjacent posts; and a prefabricated wall section disposed between said at least two elongated vertical posts and including edge portions which extend outwardly beyond said vertical posts to encapsulate said vertical posts within said wall section.

14. The wall structure of claim 13 wherein the end of each cable of the cable and turnbuckle means has a swage ball and restraining washer adapted to be inserted into the keyhole and secured therein.

15. The wall structure of claim 14 wherein the cable and turnbuckle means diagonally extends from the keyhole of the top portion of one post to the keyhole of the bottom portion of another post of the wall structure to strengthen the structure and enhance shear resistance, and align the wall sections for plumb.

* * * * *